US012504221B2

(12) United States Patent
Oh et al.

(10) Patent No.: US 12,504,221 B2
(45) Date of Patent: Dec. 23, 2025

(54) CENTRE TRIM FOR DOMESTIC APPLIANCES

(71) Applicant: Fisher & Paykel Appliances Limited, Auckland (NZ)

(72) Inventors: Do Young Oh, Auckland (NZ); Anaru Eli Hendrik Liddicoat, Auckland (NZ)

(73) Assignee: Fisher & Paykel Appliances Limited (NZ)

( * ) Notice: Subject to any disclaimer, the term of this patent is extended or adjusted under 35 U.S.C. 154(b) by 59 days.

(21) Appl. No.: 18/227,556

(22) Filed: Jul. 28, 2023

(65) Prior Publication Data

US 2024/0035736 A1 Feb. 1, 2024

(30) Foreign Application Priority Data

Jul. 29, 2022 (NZ) ..... 790799

(51) Int. Cl.
*F25D 23/10* (2006.01)

(52) U.S. Cl.
CPC ..... *F25D 23/10* (2013.01)

(58) Field of Classification Search
CPC .. F25D 23/10; F25D 2400/14; F25D 2400/18; A47B 77/08; A47B 95/002; A47B 87/007; A47B 87/008; F24C 15/30
See application file for complete search history.

(56) References Cited

U.S. PATENT DOCUMENTS 1,127,488 A * 2/1915 Morris ..... A47B 87/02 312/107
1,219,891 A * 3/1917 Williams ..... A47B 87/02 312/107
1,250,110 A * 12/1917 Vanderveld ..... A47B 87/02 312/107
1,386,615 A * 8/1921 Gach ..... A47B 87/008 312/107
1,434,220 A * 10/1922 Morris ..... A47B 87/00 312/351

(Continued)

FOREIGN PATENT DOCUMENTS

CA 1202663 A * 4/1986 ..... F25D 23/006
CN 103486114 A * 1/2014

(Continued)

OTHER PUBLICATIONS

Fisher & Paykel Appliances; Joiner Kit Instructions; Oct. 2007.

*Primary Examiner* — Andrew Roersma
(74) *Attorney, Agent, or Firm* — Clark Hill PLC; James R. Foley

(57) ABSTRACT

A centre trim for fitting between two domestic appliances such as refrigeration appliances. The centre trim is configured to attach between two domestic appliance cabinets and has a longitudinal front surface extending predominantly in one dimension, a first fixing feature at or near a first end of the longitudinal member, and a second fixing feature at or near a second end of the longitudinal member. An unsupported portion is provided between the first fixing feature and the second fixing feature. The first and second centre trim fixing features may attach in different directions, such as respectively perpendicular and parallel to the front surface.

20 Claims, 9 Drawing Sheets

(56) References Cited

U.S. PATENT DOCUMENTS

| | | | | | |
|---|---|---|---|---|---|
| 1,505,308 | A * | 8/1924 | Brown | A47B 57/10 | 211/186 |
| 1,674,913 | A * | 6/1928 | Morris | F16B 12/22 | 211/186 |
| 2,518,344 | A * | 8/1950 | Luneke | F25D 23/00 | 62/326 |
| 3,351,400 | A * | 11/1967 | Sholtes | A47B 87/008 | 312/107 |
| 5,744,213 | A * | 4/1998 | Nelson | H05K 7/20172 | 428/338 |
| 2009/0173256 | A1* | 7/2009 | LeMarr | F24C 15/30 | 108/69 |
| 2021/0190406 | A1* | 6/2021 | Seo | F25D 11/02 | |

FOREIGN PATENT DOCUMENTS

| | | | | | |
|---|---|---|---|---|---|
| DE | 19736533 | A1 * | 2/1999 | A47B 77/08 | |
| DE | 20209516 | U1 * | 10/2003 | F25D 21/04 | |
| DE | 102016109003 | A1 * | 11/2017 | | |
| EP | 2607824 | A2 * | 6/2013 | F25D 23/00 | |
| EP | 2607825 | A2 * | 6/2013 | F25D 23/12 | |
| GB | 183679 | A * | 8/1922 | A47B 87/008 | |
| KR | 20210109941 | A * | 9/2021 | F25D 23/087 | |
| KR | 20210156158 | A * | 12/2021 | F25D 23/087 | |
| WO | 2013072671 | A1 | 5/2013 | | |

* cited by examiner

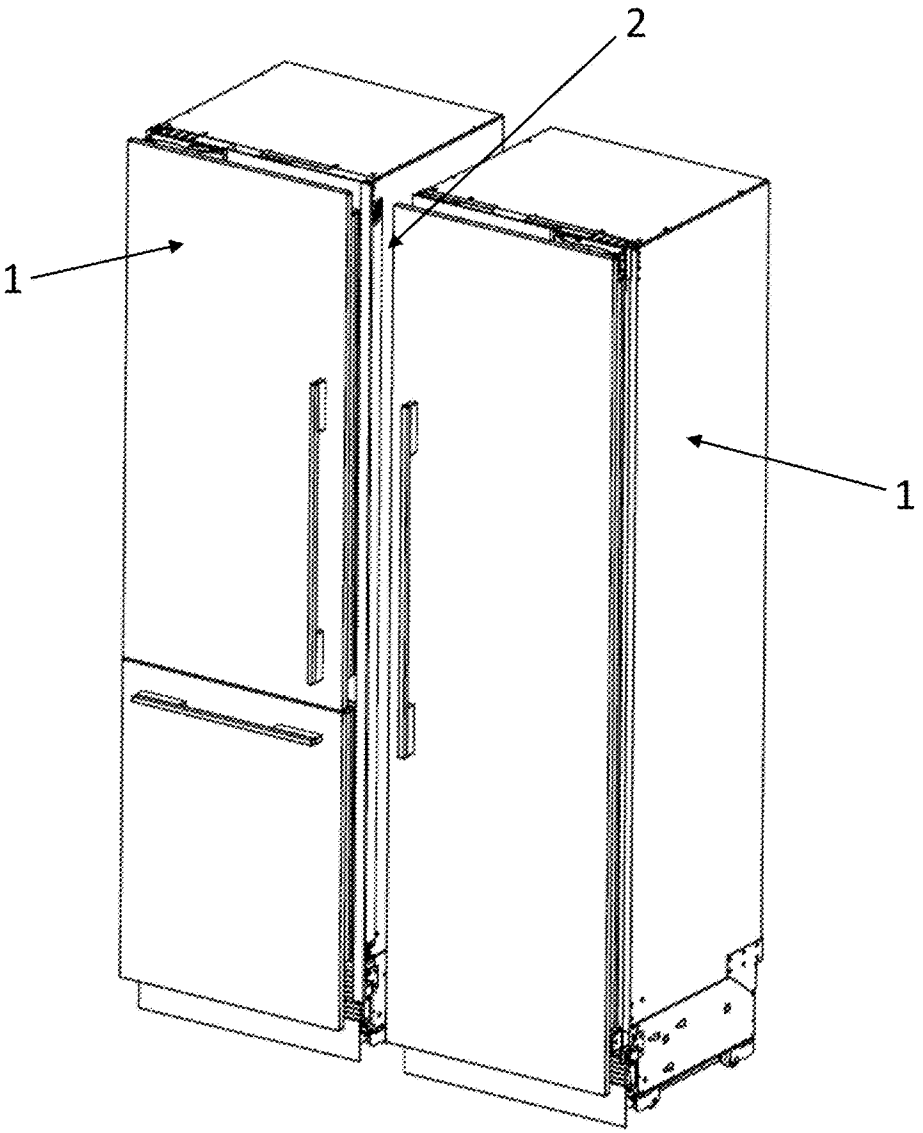
Figure 2
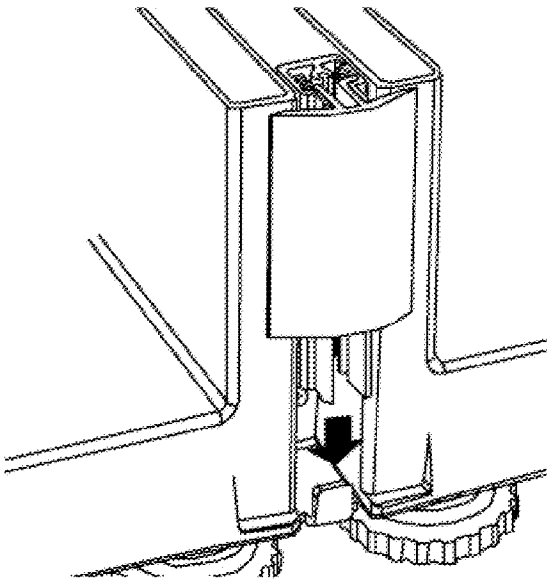
Figure 1 - PRIOR ART

CENTRE TRIM FOR DOMESTIC APPLIANCES

TECHNICAL FIELD

The present disclosure generally relates to a centre trim for fitting between two domestic appliances such as refrigeration appliances.

BACKGROUND

Domestic (i.e., "home") appliances, such as refrigeration appliances such as refrigerators and/or freezers are made in different sizes to provide choice to users or architects. While large single unit appliances are known in some cases, larger sizes are formed through the connection, or adjacent positioning, of two individual appliances. For instance, a double-width or side-by-side refrigerator can be formed by connecting, or adjacently positioning, two single refrigeration appliance cabinets side by side, with hinges on opposing cabinet sides. One or more brackets can be used to secure the relative spacing or position of the two cabinets. Other domestic or home appliances that could be mounted in pairs/multiples include laundry or washing machines, dryers, and cookers.

Due to the shape, size and operation of side-by-side refrigerators, a gap is provided between the adjacent units. Advantageously, the forward opening of this gap is closed with a trim or fascia to improve the look or appeal of the refrigerators, to hide or obscure the connection or fasteners used to connect the refrigerators and to limit access between the refrigerators for safety reasons. The side-by-side refrigerators may be freestanding or can be set into a recess, alcove or cupboard, and/or include outer panel(s) that match the corresponding cabinetry (i.e., "integrated", or "built-in" appliances).

A known method of attaching the centre trim between side-by-side refrigeration appliance cabinets attaches it with strips of reversibly detachable fasteners, such as Velcro™ or Dual Lock™ hook and loop fasteners which are arranged along the length of the gap between the cabinets. However, the center trim may become detached over time, and the fastener can be difficult to reliably place accurately between the cabinets.

FIG. 1 shows a further known method of attaching a centre trim between refrigerators using an extrusion cover and extrusion support. The extrusion support fits snuggly between the two refrigerators and is held in place vertically by brackets at the top and bottom of the gap between the refrigerators. The extrusion cover then fits into the extrusion support and has legs which engage with the extrusion support. However, inserting the extrusion support requires adjusting the joining brackets and the trim panel must be flexible (such as being formed from a plastics material) so as to be fitted to and held in place by the brackets.

SUMMARY

Although centre trims for domestic appliances exist in the art, an aspect of at least one of the configurations disclosed herein includes the realisation that there are problems with attachment of the centre trims. It is therefore an object of the invention to go at least some way to overcoming one or more of the above disadvantages.

In a first aspect the invention consists in a trim configured to attach between two domestic appliances, the trim comprising:

a longitudinal front surface extending predominantly in one dimension, a first fixing feature at or near a first end of the longitudinal member, and a second fixing feature at or near a second end of the longitudinal member, wherein the trim has an unsupported portion between the first fixing feature and the second fixing feature.

Having an unsupported span or portion between two fixing features allows the trim to be more rigid because the unsupported portion is not fixedly attached, or friction mounted, to the appliances so can move or slide relative to the domestic appliances and easily adjust to fit in the required space.

Optionally, at least one of, or both of, the first and second fixing features are configured to extend into the gap between the two domestic appliances.

Optionally, at least one of, or both of, the first and second fixing feature are configured to extend behind the front surface, or behind the plane of the front surface.

Where the fixing features extends into the gap between the two domestic appliances the trim can be attached without creating additional attachment points or areas to cover up on the front face of the appliances. Optionally also having the second fixing feature behind the front face of the trim avoids any view of the fixing feature being available to a user, once connected.

Optionally, the trim comprises one or more fins configured to protrude behind the front surface of the trim.

The use of a rib or fin protruding or extending behind the front surface of the trim provides an alignment feature for inserting the trim between the domestic appliances as well as a series of attachment points for fixing features or securing features or fasteners. The rib or fin generally extends perpendicular, or at substantially a 90-degree angle to the longitudinal front face.

Optionally, the first fixing feature is part of, on, or connected to one of the fins.

Optionally, the second fixing feature is part of, on, or connected to one of the fins.

Attaching the first and/or second fixing feature to the fin, or having the first feature be part of the fin ensures that the fixing feature is arranged behind the front face and allows the fixing feature to be placed at a depth behind the front face.

Optionally, one of the one or more fins extends substantially the length of the trim.

Optionally, the one of the one or more fins extends between the first and second fixing features.

Optionally, one of the one or more fins extends substantially the length of the longitudinal front surface.

Having the trim extend over a substantial length of the trim, or between the fixing features provides additional strength and/or rigidity to the trim as well as ensuring that any sideways movement is restricted, because the fin sits between the domestic appliances.

Optionally, one of the one or more fins extends over a substantial length of the trim, at least 50%, at least 80% or at least 90% of the length of the trim.

Optionally, the longitudinal front surface and the one or more fins are unitary.

A unitary trim comprising the front surface and the one or more protruding fins allows an extruded T-shape to be used and provides a strong and structurally resilient body. This provides a rigidity to the trim which both allows it to be attached more easily and provides an improved finished surface for the user.

Optionally, the first fixing feature is configured to fix in a direction parallel to the longitudinal direction of the front face.

Optionally, the second fixing feature is configured to fix in a direction perpendicular to the longitudinal direction of the front face.

Engaging parallel to the longitudinal direction means that the trim can be slidably fit into place at one end. This makes insertion easier and avoids potential contact with a cupboard or roof in the case where a trim is simply pushed on. Connecting the second fixing feature perpendicularly allows fixing the position of the trim.

Optionally, at least one of the first and second fixing feature comprise an opening configured to fasten or secure to a protrusion attached to at least one of the domestic appliances.

Various fixing means are usable in this system. Optionally a fixing means is an opening configured to fit over and/or grip onto or connect with a protrusion which is attached to or secured between the domestic appliances. The protrusion may be a rod or button attached to the domestic appliance. Alternatively, the protrusion comprises a mating surface, for example a plate with a groove.

Optionally, at least one of the first and second fixing feature comprises an insert, the insert configured to attach to the trim and comprising a fixing surface.

The insert may be a bracket, for instance a bracket with an opening configured for a fastener. The bracket may have a first connection portion configured to connect to the trim and a second portion configured to connect to the appliance. The first and second portion may be perpendicular or orthogonal to one another. Alternatively, the insert is a deformable opening. For instance, a flexible retainer configured to clip onto a protrusion and providing a flexibility to the system.

Optionally, comprising one or more contact features, the contact features configured to slidably contact the domestic appliances. Optionally the contact features configured to slidably contact the domestic appliances. Optionally the contact features are magnetic.

Optionally, the trim is manufacture from metal. Optionally the trim is formed as an extrusion.

Optionally, the domestic appliances comprise refrigerators or freezers.

In a further aspect the invention consists in an attachment system for attaching a trim between two domestic appliances, the attachment system comprising:

a trim as in any one of the preceding aspects; and a first connecting feature configured to attach to at least one of the domestic appliances, wherein the first connecting feature is configured to mate with the first fixing feature of the trim.

Optionally, the attachment system comprises a second connecting feature configured to attach to at least one of the domestic appliances, wherein the second connecting feature is configured to mate with the second fixing feature of the trim.

Optionally, the attachment system comprises one or more brackets, each of the one or more brackets configured to connect to one or more of the domestic appliances and configured to attach to or support the first or second connecting feature. Optionally the one or more brackets are configured to space apart two domestic appliances.

In a further aspect the invention consists in a trim configured to attach between two domestic appliances, the trim comprising:

a longitudinal front surface extending predominantly in one dimension and configured to extend across a gap between the two domestic appliances, a first fixing feature at or near a first end of the longitudinal front surface, the first fixing feature configured to extend behind the front surface into the gap between the two domestic appliances, and a second fixing feature at or near the second end of the longitudinal front surface.

The first fixing feature extending behind the front face of the trim enables straightforward connection of the trim without creating a further connection point to cover up or requiring adjustment of the attachment between the appliances after placement of the trim.

In a further aspect the invention consists in a trim configured to attach between two domestic appliances, the trim comprising:

a longitudinal member extending predominantly in one dimension, a first fixing feature at or near a first end of the longitudinal member, and a second fixing feature at or near a second end of the longitudinal member, wherein at least a portion of the longitudinal member between the first and second fixing features is configured to rest against, but not fix to, either of the domestic appliances, in use.

The first and second fixing features are used to hold the trim in place securely, allowing at least a portion between them to move freely, or at least have some movement. The unsupported portion means that the connection of the trim is more straightforward because a continuous connection, securing means or fixing means does not need to extend the length of the trim and the trim does not need to be squeezed or stuck into place between the domestic appliances.

In a further aspect the invention consists in a trim configured to attach between two domestic appliances, the trim comprising:

a longitudinal member extending predominantly in one dimension, a first fixing feature at or near a first end of the longitudinal member, and a second fixing feature at or near the second end of the longitudinal member, wherein the first fixing feature is configured to engage in a first direction parallel to the longitudinal axis of the of the longitudinal member, and the second fixing feature is configured engage second direction perpendicular to the longitudinal axis of the longitudinal member.

A first feature engaging parallel to the longitudinal axis of the longitudinal member means that the trim can be slidably fit into place at one end. This makes insertion easier and avoids potential contact with a cupboard, ceiling, or other material above the fridge, in the case where a trim is simply pushed on. After the trim has slid on parallel to the longitudinal member the second fixing feature allows the trim to lock into place. Where the first fixing feature has a tolerance to connection the sliding movement allows easy fitting of the second connection reducing accuracy requirements.

In a further aspect, the invention consists in a trim configured to attach between two domestic appliances, the trim comprising:

a longitudinal front surface extending predominantly in one dimension and configured to extend across a gap between the two domestic appliances, at least one fin configured to extend behind the front surface, the at least one fin configured to extend into the gap between the two domestic appliances, a first fixing feature on a first of the at least one fins, the first fin at or near a first end of the longitudinal member, and a second fixing feature at or near the second end of the longitudinal member.

The use of a fin to be or hold at least the first fixing feature allows the fixing feature to be easily guided into a position between the domestic appliances. It also ensures that the fixing feature is hidden or obscured behind the centre trim when in place.

Features from one or more embodiments or configurations may be combined with features of one or more other embodiments or configurations. Additionally, more than one embodiment or configuration may be used together in a respiratory support system during a process of respiratory support of a patient.

As used herein the term "(s)" following a noun means the plural and/or singular form of that noun.

As used herein the term "and/or" means "and" or "or", or where the context allows both.

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

This disclosure may also be said broadly to consist in the parts, elements and features referred to or indicated in the specification of the application, individually or collectively, and any or all combinations of any two or more said parts, elements or features.

Where specific integers are mentioned herein which have known equivalents in the art to which this disclosure relates, such known equivalents are deemed to be incorporated herein as if individually set forth.

The disclosure consists in the foregoing and also envisages constructions of which the following gives examples only.

BRIEF DESCRIPTION OF THE DRAWINGS

Specific embodiments and modifications thereof will become apparent to those skilled in the art from the detailed description herein having reference to the figures that follow, of which:

FIG. 1 shows a prior art arrangement of a centre trim in the gap between two refrigerator cabinets.

FIG. 2 shows an isometric view of two refrigerator cabinets arranged side-by-side.

DETAILED DESCRIPTION

FIG. 2 shows a pair of refrigeration appliances 1 with a gap 2 between their cabinets. Refrigeration appliances can be connected by one or more brackets, with the gap 2 between them providing required spacing. A centre trim may be used to cover the forward-facing opening of the gap 2.

Figure 3:
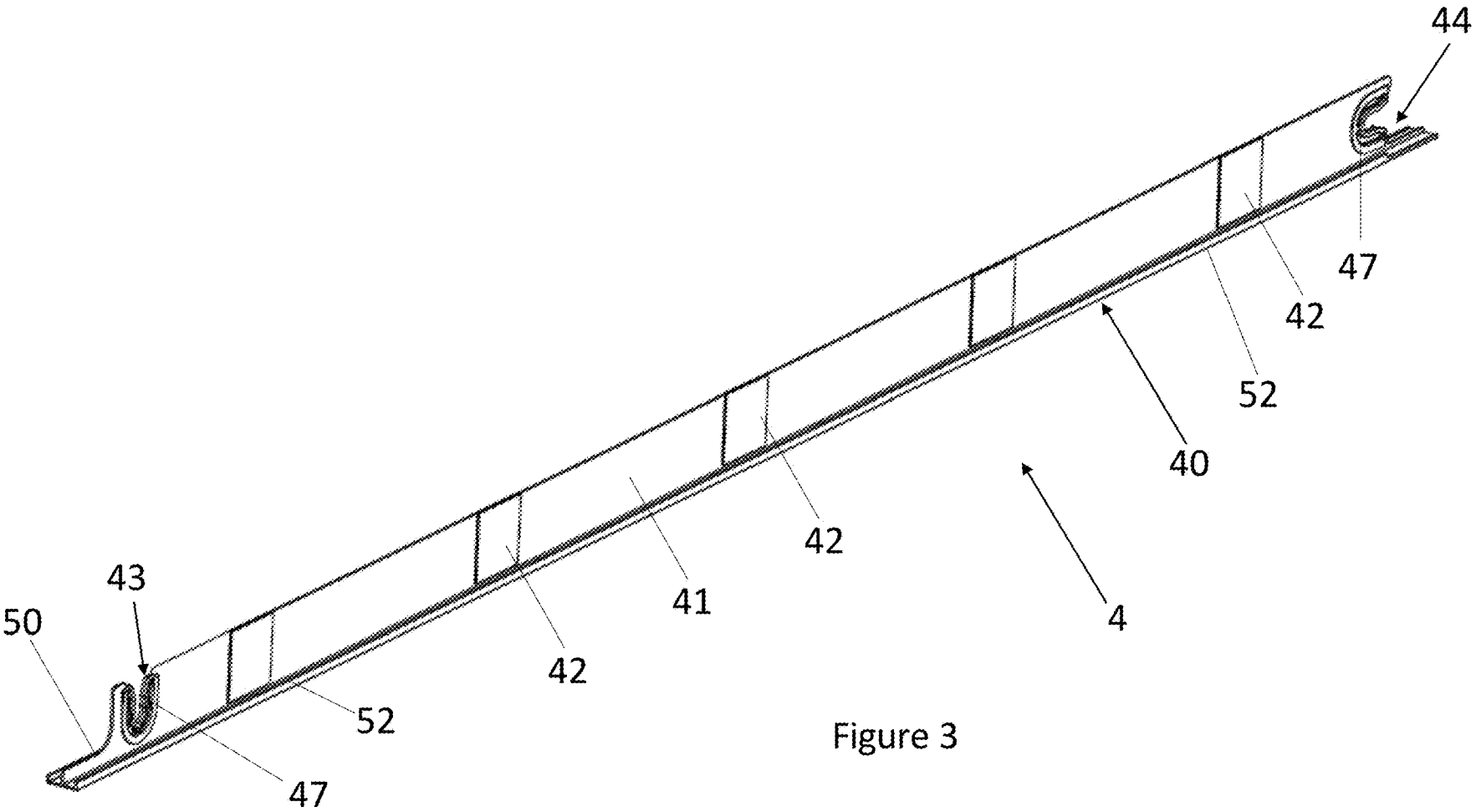
FIG. 3 shows a centre trim embodiment.

FIG. 3 shows a trim or centre trim 4 configured to secure between two domestic appliance cabinets, such as refrigeration appliances 1 (i.e., refrigerators, freezers or combination refrigerator/freezers). The trim 4 has a front face 40 which has a width to span and therefore cover, the horizontal distance or gap 2 between two domestic appliances. The front face 40 extends longitudinally so that, when attached to or between the domestic appliances the longitudinal axis is substantially vertical and the front face 40 or fascia covers all, or substantially all, or most, or at least a portion, of the vertical height of the domestic appliances.

FIG. 3 has a planar protrusion, such as rib or fin 41, which extends away from the front face 40 of the centre trim 4. The fin 41 is narrow enough to enter the gap 2 between the domestic appliances and, once inserted, may limit the movement of the trim 4. A single fin 41 is shown, however a plurality of fins (spaced or separated vertically) could be used instead, with gaps between them. For instance, fins could only be present at 2, 3, 4 or 5 locations along the centre trim 4. The depth of the fin 41 may vary along its length (or the plurality of fins could have different depths), where depth refers to the distance or length of the protrusion away from the front face 40. FIG. 3 shows a shorter depth portion 50 at a first end of the fin 41. This allows the fin 41 to be adapted depending on the available gap. The depth of the fin 41 may vary along its length. However, preferably it has a middle portion with a substantially constant depth and a reduced depth at first and/or second ends, as illustrated in FIG. 3.

Optionally the fin is about 2 mm thick. The fin may have a tolerance of plus or minus about 0.2 mm. Optionally the fin is between 1 and 3 mm thick, or between 1 and 5 mm thick. Optionally the fin is less than 5 mm thick, less than 7 mm thick or less than 10 mm thick. Optionally the fin has a tolerance of less than 1 mm, less than 0.5 mm or less than 0.2 mm. The fin may have at thickness relative to the size of the gap, and the tolerance is the refrigerator surfaces. For example, the fin may be configured to fit snuggly (e.g. with less than 1 mm or 2 mm gap) between the refrigerators when accounting for the refrigerator surface tolerances. The snug fit can reduce vibration or movement of the centre trim when the refrigerators are used. Alternatively, or in conjunction, contact features 42 such as a magnet or magnets, spaced apart on fin 41 can be used to reduce vibration or movement.

FIG. 3 shows further planar protrusions or fins 52 on each side of the front face 40. These fins 52 protrude or extend away from or behind the front face 40 and are configured to rest against the front face of the domestic appliances 1. Generally they extend substantially perpendicular to the front face 40 of centre trim 4, or parallel to the centre fin 41. Some embodiments may have no side fins 52, or one or two side fins 52 depending on the style of domestic appliance being connected to. As with the central fin 41, the depth of the side fin may vary along the length of the trim. In some embodiments the side fin 52 may be configured to also fit between the domestic appliances so as to more securely support the centre trim 4 in place. The side fins 52 may not extend the full length of the refrigerator, sections of the fins 52 may be removed or recessed so as to allow for, or contour, to features of the refrigerator 1. FIG. 8D, for example, shows the sides fins 52 stopping before the top of the refrigerator so as to avoid a top trim 80 of the refrigerator. Similar trims may be arranged at the base of the refrigerator, or elsewhere.

The centre trim 4 has first and second fixing or securing features 43, 44. The fixing or securing features are configured to fixedly position the trim 1 in relation to the domestic appliances, in use. In some cases, the fixed position is achieved through interaction between the at least two fixing features. For instance, attachment of one fixing feature may lock the other fixing feature into position. Other portions of the centre trim 4 may also be in contact, or in slidable connection with, the domestic appliance without forming a fixed connection.

FIG. 3 shows the contact features 42 attached to fin 41. The contact features 42 may also or alternatively be attached to the back of the front face 40. Five contact features 42 are shown, however there may be 1 or more of them, or a continuous contact feature between the first and second fixing features. The contact features 42 are configured to maintain contact with, but are able to move relative to, one or both of the appliances 1. In FIG. 3 they are illustrated as a plurality of magnetic strips or pads. The magnetic strips may be on one, or optionally both, sides of fin 41. The magnetic strips or squares 42 secure or hold the fin or centre trim 4 to one or other of the domestic appliances 1 to reduce the ability of the fixing features to move, and, for instance, slide off their corresponding mating features. The contact features 42 or slidable connections also help to ensure alignment (vertical) of the centre trim 4 relative to the domestic appliances 1.

Figure 4A:
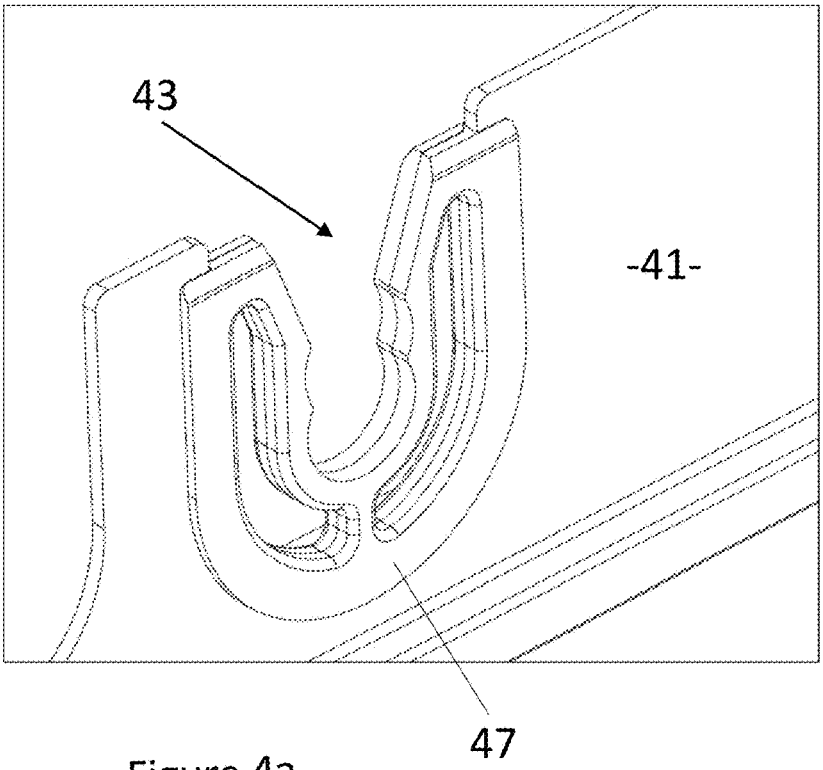
FIGS. 4*a* and 4*b* illustrate fixing features on the centre trim of FIG. 3.

FIG. 4*a* shows details of the fixing feature 43 illustrated in FIG. 3. Fixing feature 43 is located on fin 41. Fixing feature 43 is arranged with an opening that is directed, or faces in such a way as to enable mating therewith in a direction, perpendicular (i.e. at substantially 90 degrees or between about 85 and 95 degrees) to front face 40 and in the plane of fin 41. In the illustrated embodiment a fitting 47 is located in an opening 43*a* in the fin 41, the fitting 47 configured to engage with a protrusion or mating feature located between, and connected to at least one of, the domestic appliances 1. Fixing feature 43 is located near a first end of the centre trim 4. The fixing feature 43 may be located at or near an end, or change in depth of, fin 41 (i.e., before fin 41 changes depth to fin 50).

Figure 4B:
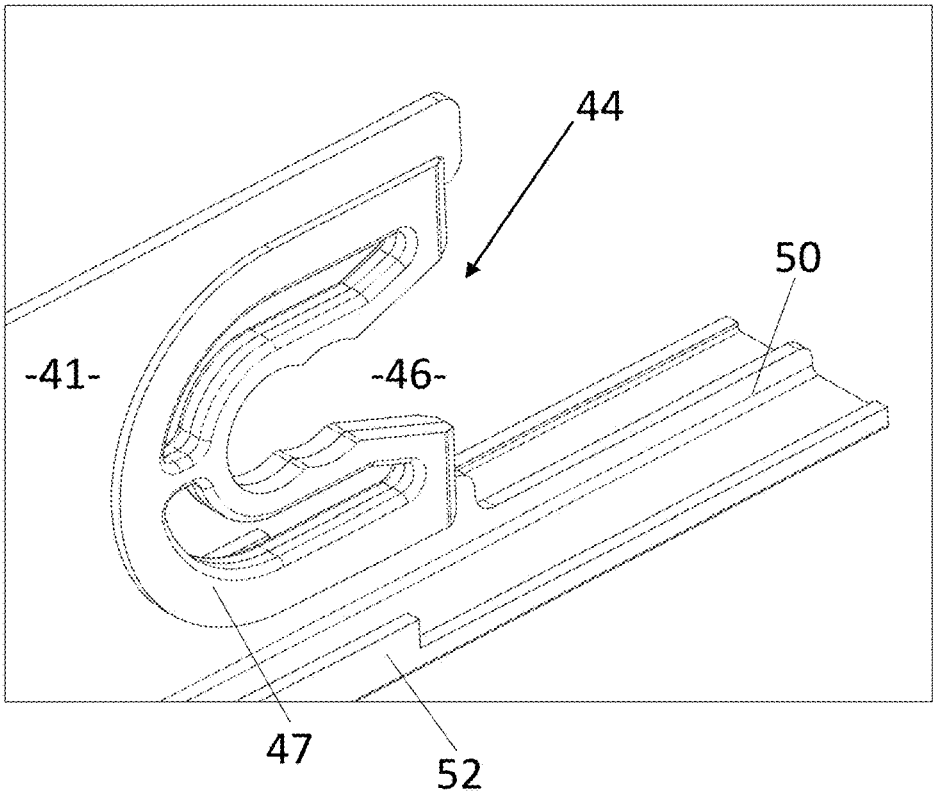

FIG. 4*b* shows details of the fixing feature 44 illustrated in FIG. 3. Fixing feature 44 is located on fin 41. Fixing feature 44 is at the opposite or distal end of the centre trim 4 to fixing feature 43. Fixing feature 44 is arranged with an opening, or arranged to connect in a direction, substantially parallel to the longitudinal direction of the centre trim 4. Fixing feature 44, similar to fixing feature 43, has a fitting 47 mounted in or to an opening 46 of fin 41. Alternatively, either fixing feature may be an opening, or an opening with a contoured surface or rim to fix to a mating surface. Alternatively, other fixing features known in the art may be used. The centre trim 4 may have similar or different fixing features at either end. The perpendicular connection may be located at the bottom end with the parallel connection at the top end of the centre trim or vice-versa.

The fittings 47 shown in FIGS. 3 and 4 are flexible (for example, elastomeric) retainers that clip on to a mating joiner. The mating joiner can be contoured to improve the retainment, or make it more difficult to remove. It is possible to instead use other fixing features or fittings. Alternatively, the fixing features 43, 44 can be reversed, so that the flexible retainer is mounted between the appliances and the mating joiner provided on the rear of the trim member. Other fixing features include clips, snap-fits and suitable fasteners/openings for fasteners.

Figure 5B:
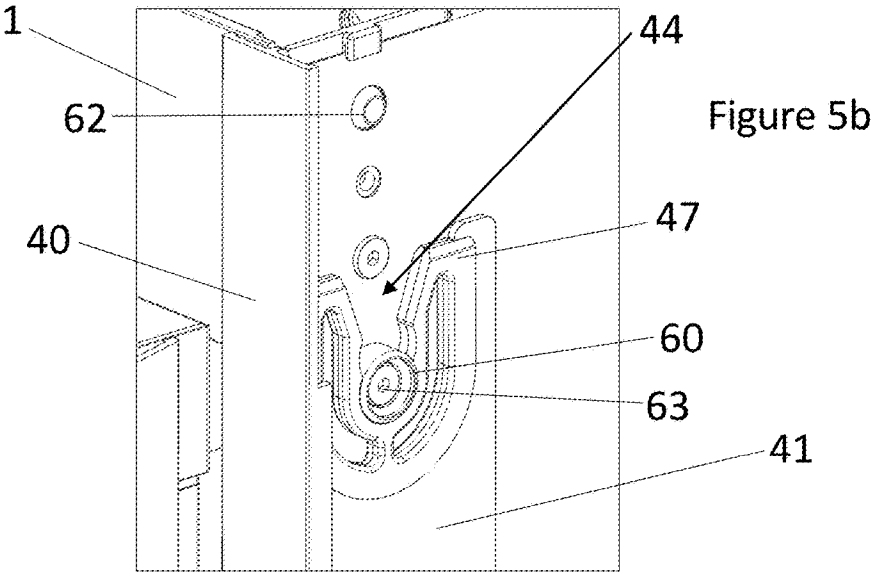
FIG. 5*a* shows a cut-away view of the centre trim arranged between refrigerator cabinets and FIGS. 5*b* and 5*c* show details of the fixing features.
Figure 5C:
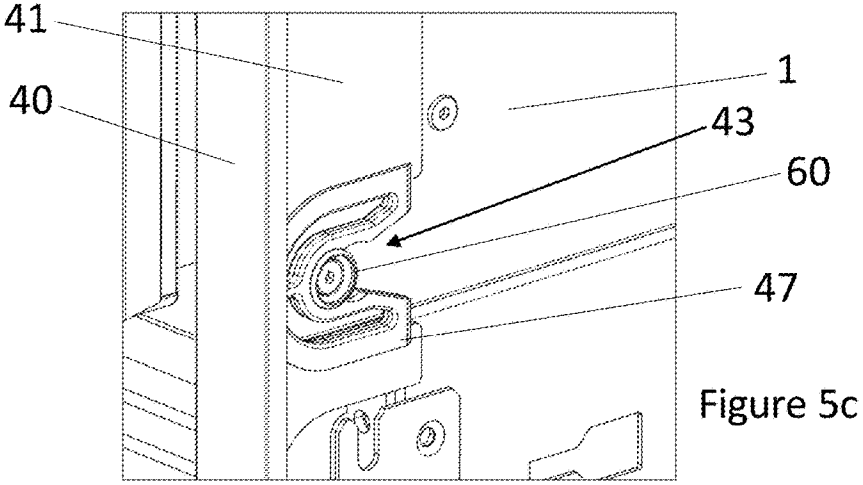
Figure 5A:
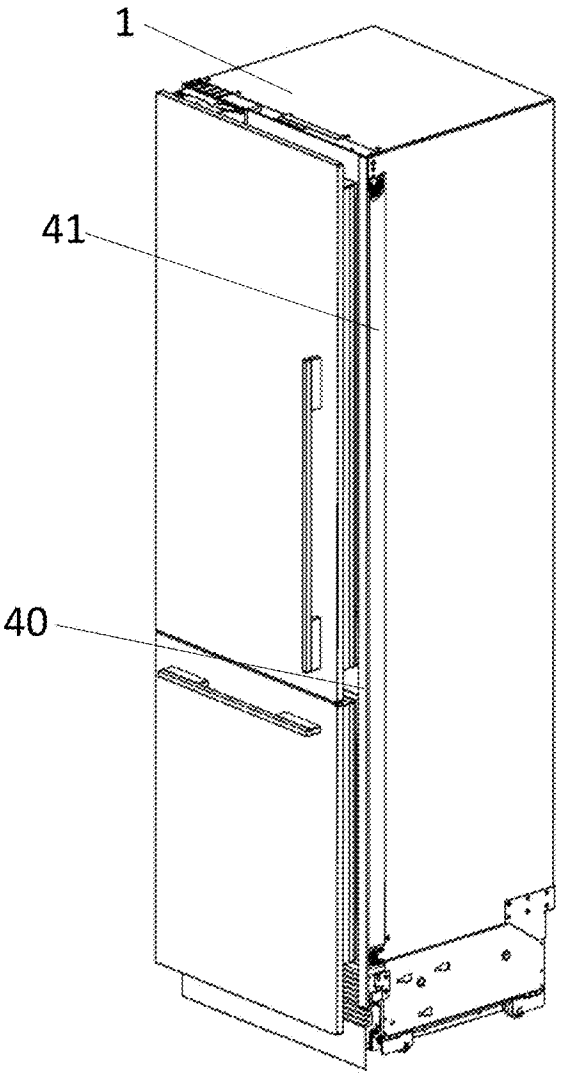

FIG. 5*a* shows the centre trim 4 mounted in a gap between refrigerators 1 (with the second refrigerator removed to show the attachment). Mating feature or ring 60 (see FIGS. 5*b* and 5*c*) is configured to securely fit or friction fit within the fitting 47, in use. The shape and configuration of mating feature 60 is variable, and can be changed to mate with the corresponding fixing feature 43, 44. In some cases the mating feature has a flange, fin, groove or other surface contour to avoid or limit sideways movement of the trim. In other embodiments a fastener with a mounting such as screw and sleeve may be used. The mating feature may be inflexible, or solid, or rigid, or substantially incompressible, in contrast to the flexible retainer. Alternatively, the retainer could be inflexible and the mating feature flexible.

FIG. 5*a* shows that the centre fin 41 locates in the gap 2 between the domestic appliances 1 with the face 40 of the centre trim 4 facing outwards and covering the gap 2. In some cases centre trim 4 is inserted at the top (parallel) fixture 44 first during installation. When the fixing feature 44 is parallel to the longitudinal axis of the centre trim 4 the fixing feature 44 is able to slide along or parallel to the gap 2 until the fixing feature 44 locates against or mates with the ring or wheel 60 or other fixture in the gap 2. This sliding action, in this case from below, reduces the risk of the centre trim 4 contacting a cupboard, ceiling, or feature above the domestic appliance 1 which can cause scratching. Where there is no fin 41, or a smaller fin, the fixing feature itself may enter the gap to engage the mating feature therein. The second (lower) fixing feature 43 can then be slid in, by rotating the trim member about mating feature 60, so that the lower end of the trim moves in a direction perpendicular to the longitudinal axis of the trim member. This locks the vertical position of the first fitting 44 and secures the centre trim 4.

FIGS. 5*b* and 5*c* show example attachments of mating feature 60 and fixing features 43, 44 parallel (5*a*) or perpendicular (5*b*) to the gap 2. A fastener 63 is used to secure the mating feature 60 to a suitable fastener attachment position or opening of the domestic appliance 1, the fastener 63 may be a screw or mounting hole. The fastener 63 or ring 60 is shown secured to a single one of the domestic appliances 1, however it is possible to instead connect the mating feature(s) to both domestic appliances 1, or secure them between the domestic appliances. In some cases, the ring or fixing connection may be attached to a fastener configured to connect the appliances. The fixing connection is configured to provide a surface or component to mate with and fix, optionally reversibly fix, to the fixing feature 43, 44 and therefore fix the centre trim 4 in place.

FIG. 5*b* shows the connection of the second fixing feature at or near the bottom of the centre trim. The second fixing feature 44 may connect perpendicularly to the longitudinal axis. This arrangement allows the second fixing feature 43 to connect after the first fixing feature has been located or fixed and to secure the vertical position of the centre trim 4 relative to the domestic appliances. For instance, the first fixing feature 44 may have a play or tolerance so as a rigid centre trim 4 can be used, and the play or tolerance of the first fixing feature 44 ensures that the second fixing feature can engage or mate with the appropriate mating feature securely. The play or tolerance can be achieved by having a longer opening in the fixing feature 44, optionally with on or a plurality of locations where fixing can occur.

Figure 6B:
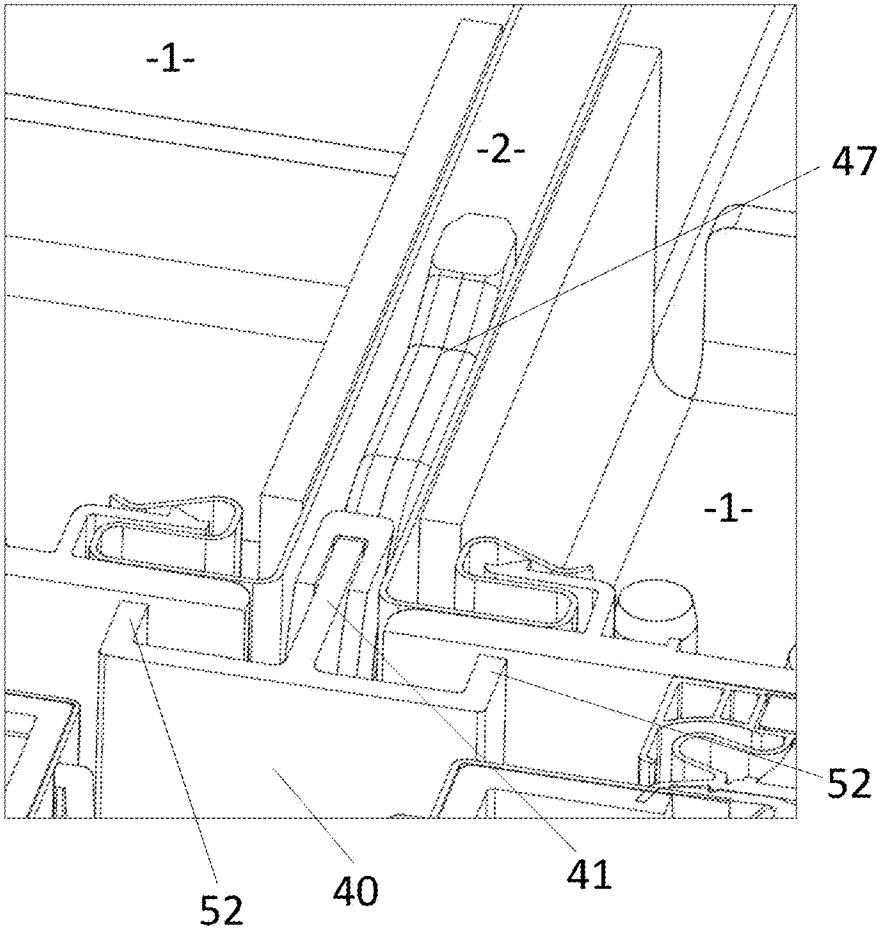
FIG. 6 shows cutaway views of the centre trim attachments to a refrigerator at (a) top and (b) bottom end of the centre trim.
Figure 6A:
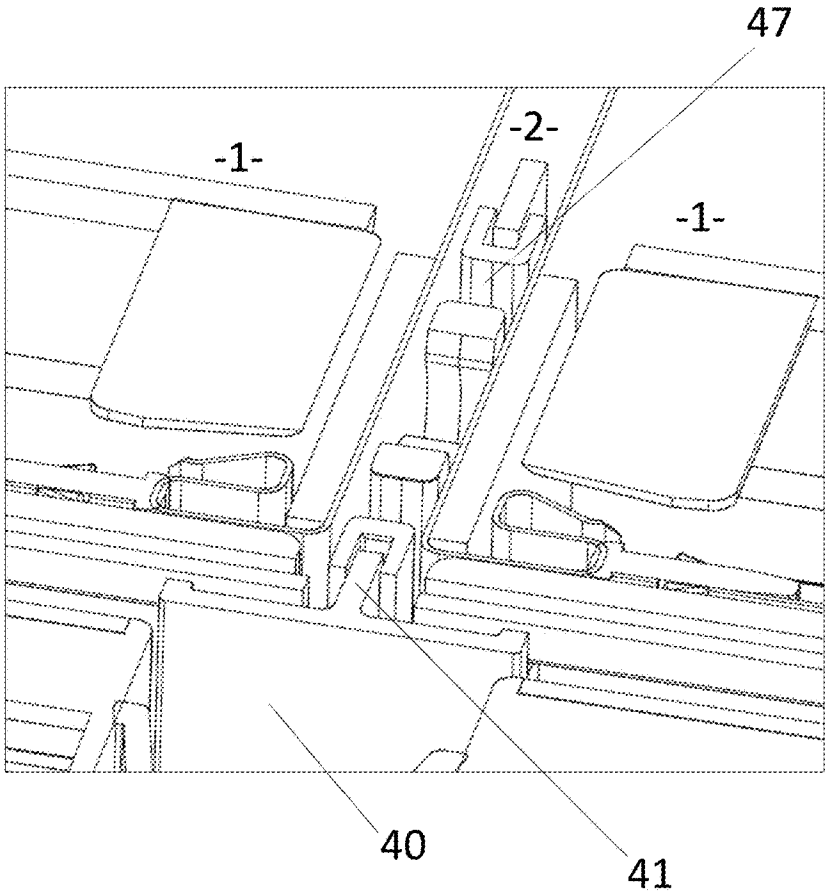

FIG. 6 shows a cut-away view of the connection of the fixing features in perpendicular (FIG. 6*a*) and parallel (FIG. 6*b*) arrangements. FIG. 6*a* shows a view of the gap 2 between two appliances 1 at the top or higher end (although either end may have similar components). The fin 41 fits into the gap with the fitting 47 of the fixing feature also fitting into the gap and arranged to clip onto mating element 60 (not shown). The depth of the mating feature ensures that the front face 40 is correctly positioned. Similarly, FIG. 6*b* shows the connection at the bottom or lower end, where the fitting 47 is clipped or secured to a second mating element 60.

The side-by-side appliances can be connected by spacers or connectors comprising fasteners and supports to set the gap width between the cabinets of the domestic appliances, although other techniques including brackets are known. In some cases, no connector is used in which case ring or mating element 60 may be attached directly to at least one of the appliances 1. The mating element 60 may have a flange configured to rest against one of the appliances. In some cases, the ring or mating element 60 also forms the connector connecting the two appliances 1. The mating feature 60 is located or secured in the gap so that the fixing feature 43, 44 attaches to it. In the illustrated case, the fixing feature of the centre trim could either slide on from below, or clip directly on from straight ahead of the appliances.

FIGS. 7*a* to 11 show an alternative, second embodiment of the centre trim 4 which has alternative fixing features. Further fixing features, or mixtures of the described fixing features are also possible. For example, opening 43*a* of this second embodiment could act as a fixing feature. The screw mount fixing feature 70 is attached to the fin 41 of the centre trim 4. The screw mount fixing feature comprises a bracket 72 which is fixable or fastenable to the fin 41, for instance by fasteners 73 shown as screws. A second portion of the bracket 72 has a fastener portion 71 configured to fasten with a feature or bracket 74 (see FIGS. 7*b* and 7*c*) of, or connected to, one or both of the domestic appliances 1. The bracket 72 may have a twist or shape to change the angle between the portions or may be straight. In the illustrated case the angle changes from parallel to the fin 41, to parallel to the front face 40. Alternatively, the fixing feature 70 is unitary with the fin 41 or connected directly to the back face of centre trim 4. The fixing feature is illustrated as an aperture suitable for taking a fastener and being fastened to a mating location. Alternatively, the fastener may be a hole or opening suitable for engaging with a mating fastener, a protruding screw or bolt, or other fixing means. Opening 43[a] in the fin is configured to support a fixing feature according to the previous embodiment, however this is not required. The further features, such as secondary fins 52 described for the previous embodiment may also be used where possible.

Figure 7B:
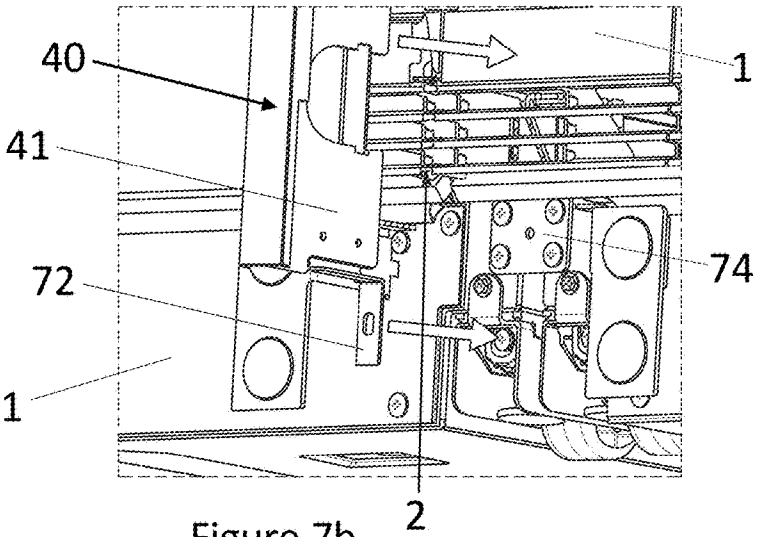
FIG. 7 shows (a) an alternative fixing feature, (b) a method for connecting it between two refrigerators, and (c) the alternative fixing feature in place.

FIG. 7*b* shows the attachment or fixing of the fixing feature 70 to the domestic appliances. The trim is preferably already positioned or fixed at the other (i.e., upper) end, so that fixing feature 70 rotates about the upper mating or fixing feature, moving perpendicularly to the longitudinal axis of the centre trim 4 into the gap 2 between the domestic appliances. In some cases, the centre trim is positioned in the gap and slides so as to fix, or locate suitable for fixing, at both fasteners substantially concurrently. The fastener portion 71 is configured to abut or rest against a mating fastener portion, such as one on a bracket, sitting in the gap 2 or bridging between the appliances 1. Similar to the earlier example the fin 41, if present, slides into the gap between the appliances 1.

Figure 7C:
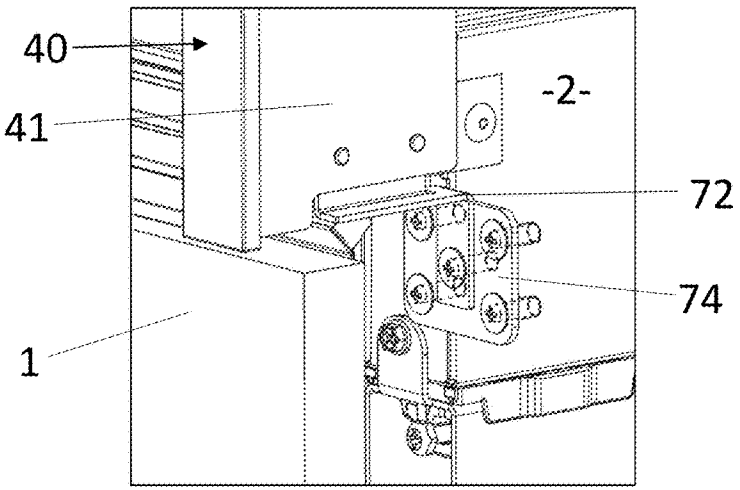

FIG. 7*c* shows the attachment as connected to bracket 74 attached to refrigerator 1. The connection fixes the centre trim 4 in place with the fin 41 in gap 2. The fixing fastens the centre trim so that it is unable to move vertically. It is shown using a screw or bolt, but other fasteners may be used. In combination with a horizontal (or substantially horizontal, or at least a fastener on a different angle) this enables the centre trim 4 to be slidably locked or fixed in position.

Figure 8A:
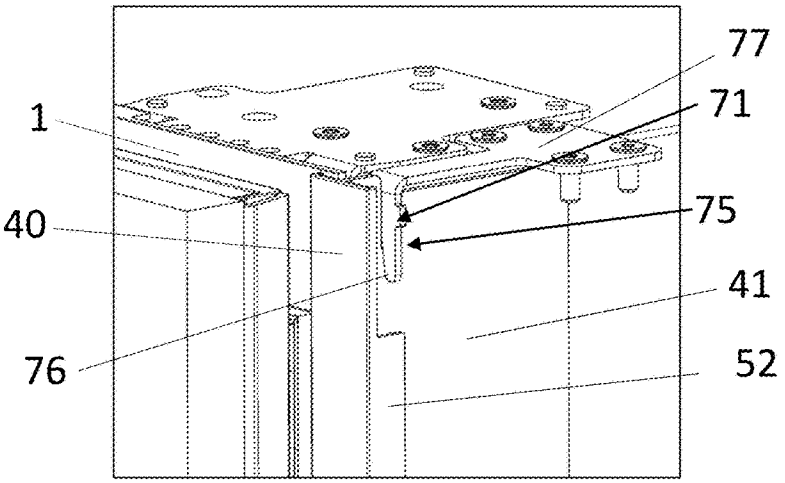
FIG. 8 shows (a) an alternative fixing feature, (b) a method for connecting the fixing feature and bracket, (c) the matching between the fixing feature and a bracket, and (d) the connected centre trim.
Figure 8B:
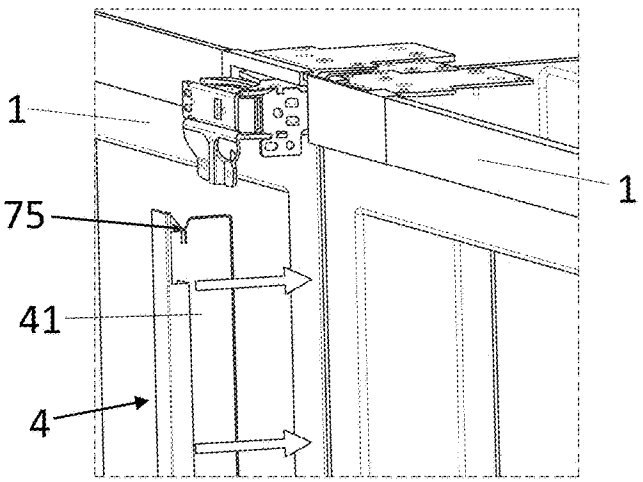
Figure 8C:
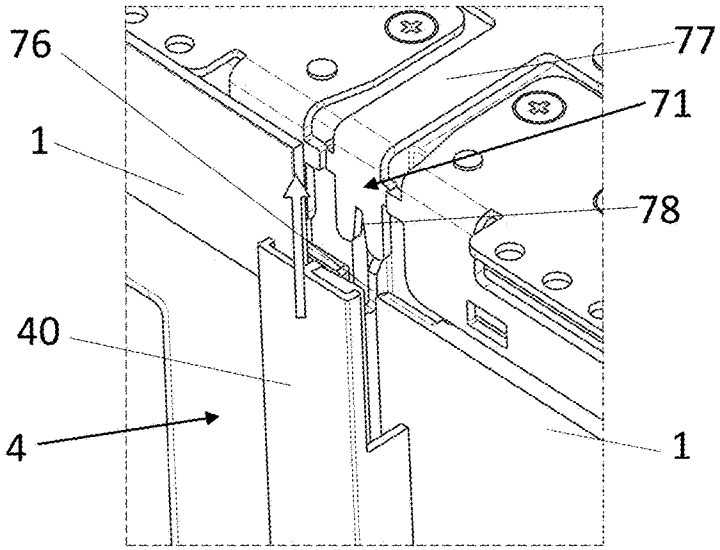
Figure 8D:
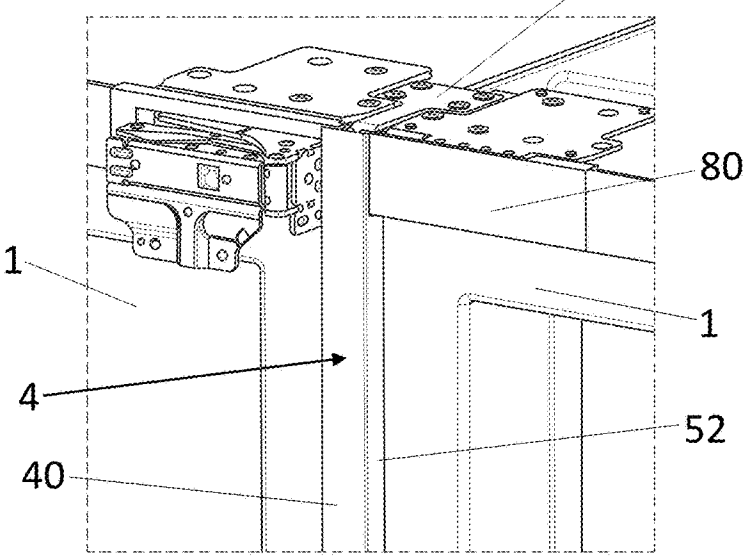

FIGS. 8*a*, 8*b*, 8*c* and 8*d* show a further fixing means for the centre trim 4. The fixing feature 75 is shown at the top end of the centre trim 4. The fixing feature 75 comprises a recess 76, such as a slot, groove, or opening, configured to engage with a recess 78 attached to the appliances 1. As best shown in FIG. 8*b* the slot 76 can be made in fin 41 behind front face 40. The slot 76 may comprise a portion with substantially vertical sides and a portion having a chamfer or slope on at least one of the sides. This helps with insertion of the centre trim 4 because of the greater width at the mouth of the slot 76. A centre trim may comprise fixing feature 75 combined with fixing feature 70 on respective ends.

The mating portion 71 or engagement feature attached to the appliance may be part of a bracket 77 connected or securing the two domestic appliances together. The bracket 77 has an end providing a mating portion 71 with the fixing feature 75. As shown in FIG. 8*c* this mating portion 71 is parallel to the longitudinal axis of the centre trim 4 when the trim is connected or attached to the appliance(s). The bracket 77 may comprise a first portion configured to connect the appliances 1 and a second portion or end to mate with the centre trim 4. Using an integral bracket with both portions reduces the number of components and allows the position of the mating portion 71 to be accurately located relative to the bracket, ensuring the centre trim cannot exceed the height of the bracket (and/or an alcove that the refrigerators may be positioned within). The second portion may be substantially perpendicular to the first portion.

Optionally, the engagement portion 71 (shown in FIG. 8*c* on the second portion) also has a recess 78 such as a slot, groove or notch to better engage with the fixing feature 75. The notch 78 in the engagement portion may be formed between two protrusions. Where both fixing feature 75 and bracket 77 are notched or have engagement slots 76, 78 the centre trim is fixed horizontally and vertically when the fixing feature 75 and bracket 77 engage. The notch 78 may have a narrowing or v-shape in the direction of the connection with centre trim 4. This allows the centre trim to wedge into the notch 77. The notch may narrow to a width less than the width of fin 41, so as to ensure the fin 41 makes secure contact with the notch 78 when inserted. Optionally different notch geometries may be used. The use of a vertical connection also allows the connection to be used as a datum to ensure alignment of the centre trim 4 at the desired height.

FIG. 8*d* shows the centre trim 4 in position with the face or fascia portion 40 facing outwards and covering the gap between appliances 1 (some parts of appliances, e.g., doors, are not shown). Bracket 77 is shown as both locating or fixing the centre trim 4 as well as fastened to both appliances as a bracket to maintain the correct separation between them. Alternatively, the bracket 77 could be attached to a single appliance 1 and/or sit in the gap 2 between the appliance attached to either or both of the appliances 1. As shown in FIG. 8*c* the mating slots or openings 76, 78 allow the centre trim 4 to be connected by sliding the centre trim upwards. This reduces the chance of scratching or damaging cabinetry, ceilings or other apparatus above the appliances 1. Where the direction of connection of the first and second fixing features is different, the centre trim 4 cannot simply slide off if pulled, as this only exerts an effective force against one of the connectors while the other connector resists movement, making the connection more robust.

Figure 9:
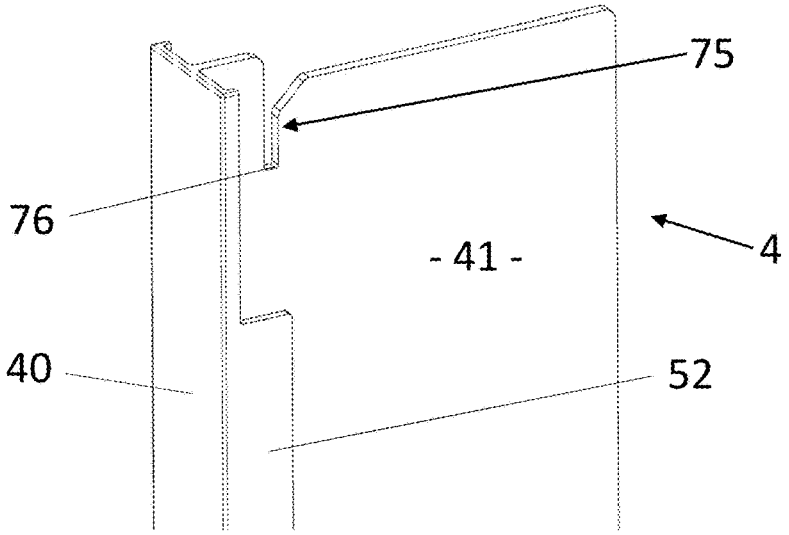
FIG. 9 shows the alternative fixing feature of FIG. 8 in detail.
Figure 11:
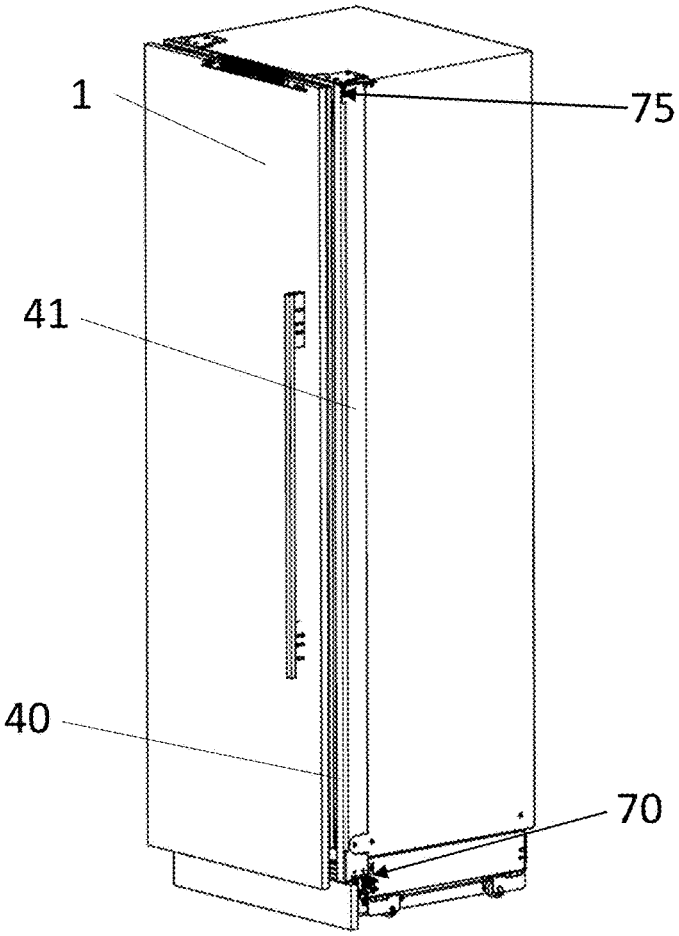
FIG. 11 shows the centre trim of FIG. 10 attached to a refrigerator cabinet.
Figure 10:
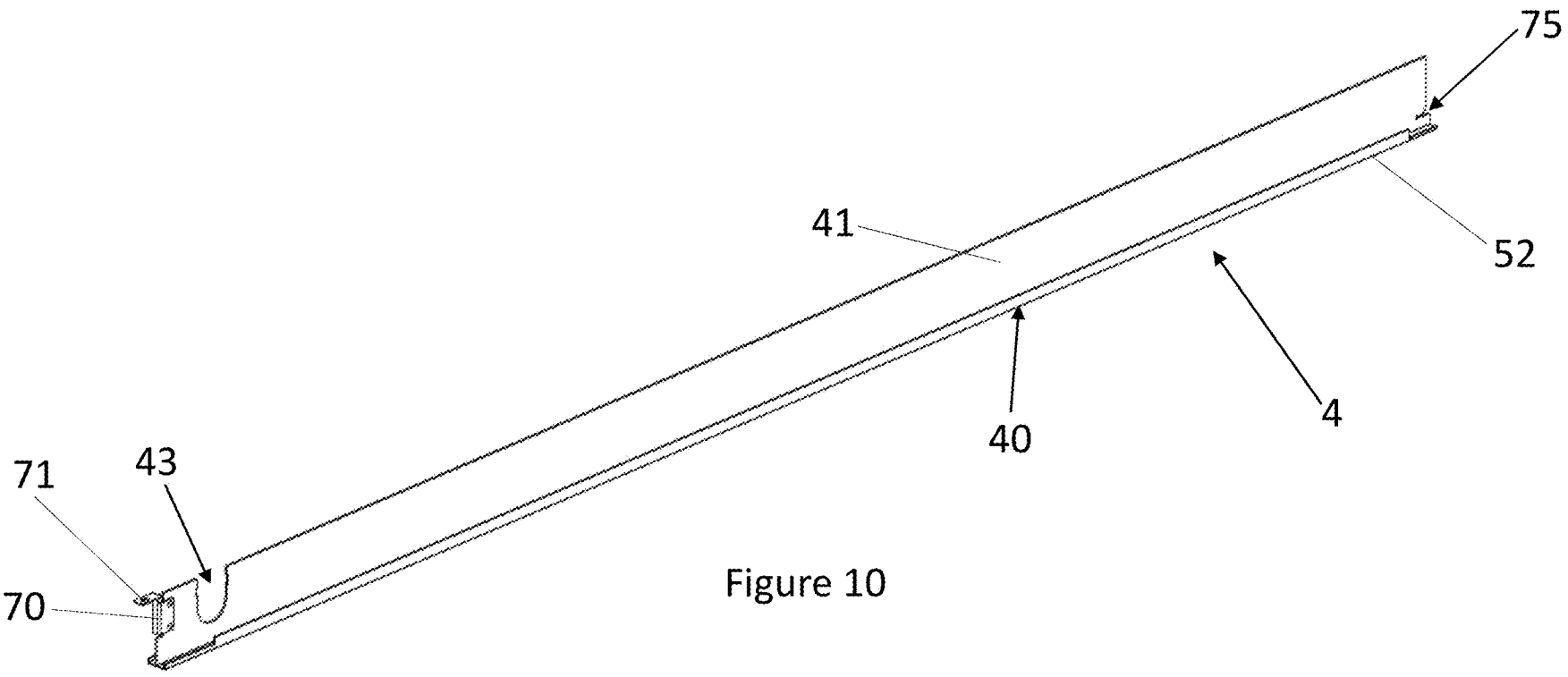
FIG. 10 shows a centre trim embodiment with the fixing features of FIGS. 7 and 8.

FIG. 9 shows the fixing feature 75 at a first end of centre trim 4. The fixing feature 75 is a notch or recess 76 cut into the fin 41 behind the face or front surface 40. This enables the fixing feature 75 to be formed or cut from an extruded centre trim, making manufacture of the piece easier. In particular the extrusion can be strengthened plastic or metal, so that the centre trim 4 is substantially rigid, or able to hold its shape to make insertion easier. The profile of the recess 76, including width, depth and/or slope of the one or more sections of side wall may be configured to mate with the mating bracket tightly while being easy to install. As shown in FIG. 9, the fin 41 at the top of the recess 76 may be lower to allow the centre trim to sit beneath bracket 77. FIG. 11 shows the centre trim 4 as mounted to refrigerator 1 (with the second refrigerator not shown). Fixing features 70, 75, at either end securely fix the trim in position, without requiring continuous fixing or contact along the length of the trim. Slidable fixtures such as magnets may be placed along the length, for instance of fin 41, to provide additional security or ensure vertical positioning of the centre trim 4 as explained above in relation to the first embodiment.

Figure 7A:
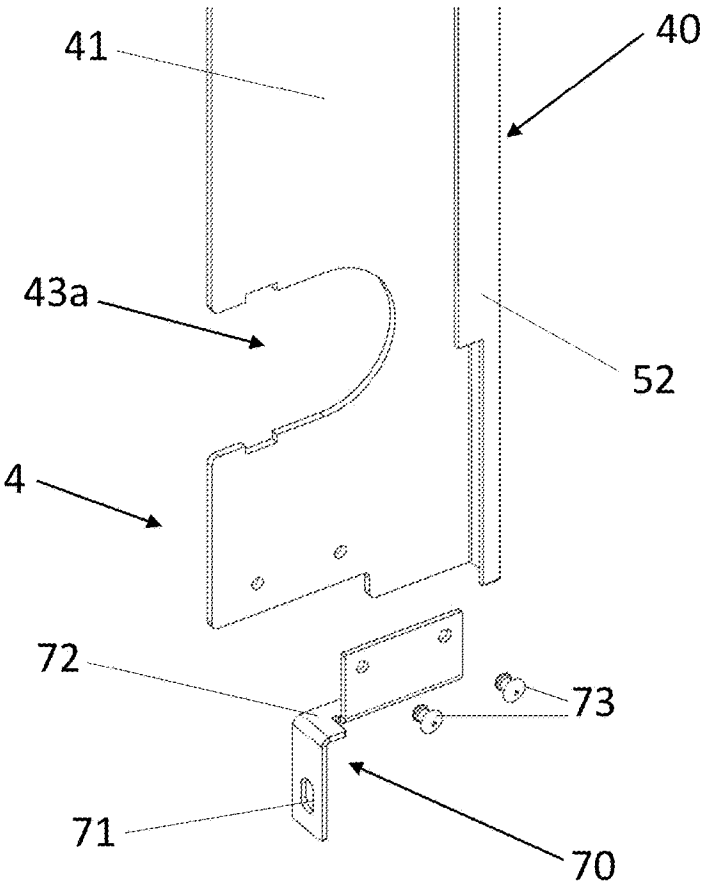

Optionally, the centre trim 4 is substantially rigid along its length, for instance substantially maintaining its shape when not fixed at either end. The rigidity may be achieved by the material type or structure of the centre trim. For example, a metal (e.g., Aluminium) or hard plastic centre trim may be used. Alternatively, or as well, the rib(s) 41, 52 may provide structure or support to the centre trim 4. Optionally, the trim 40 is formed as an extrusion. The extrusion may have a T profile with the top bar forming the front face and the vertical bar forming the fin. Various fixtures or fittings may be attached to the extrusion to provide or improve features such as the fixing features. The front face 48 and fin 41 are optionally a unitary part, or form a single piece. The fixing features may be part of this single part. However, the fixing features may also be separate parts, or may comprise separate parts attached to the front face, or the fin 41. FIG. 7*a* shows the fixing feature being attachable to the fin 41, although a unitary structure of this portion is also possible. Having a substantially rigid or shape-holding centre trim 4 reduces undesirable rattling or movement of the centre trim 4 when opening or closing of the refrigerator doors or during movement of the refrigerators.

The fixing features 43, 44, 70, 76 are preferably positioned at substantially either end of the centre trim 4, so as to secure each end of the trim. The centre trim 4 may have one or a plurality of further fixing feature(s) arranged along the longitudinal length, for instance at a mid-point. The further fixing feature may be orientated with its opening directed parallel or perpendicular to the longitudinal axis of the centre trim 4. The spacing between the fixing features may be at least half the height of the centre trim, more than 80% the height of the trim or more than 90% the height of the trim. Having the fixing features spaced apart enables a middle portion to have substantially no contact with the centre trim, so movement of the centre trim relative to the appliances is possible. Where contact features 42 are present, optionally there is a portion with neither a contact feature configured to contact the domestic appliances within the gap, nor a fixing feature. The non-contact portion is optionally a majority of the portion between the first and second fixing features.

Optionally, the longitudinal axis of the centre trim 4 is between about 1 m and about 2 m long; optionally, between about 1.5 and about 1.9 m long; optionally between 1.6 and 1.8 m long; optionally between 1.7 and 1.8 m. The rib 41 optionally has a depth (distance extending substantially perpendicular from the front face) of at least 30 mm; optionally, at least 50 mm; optionally, at least 70 mm; optionally, between about 50 mm and about 100 mm; optionally, between about 60 mm and about 80 mm; optionally, about 75 mm. Optionally, the centre trim (except for the rib 41 as discussed above) has a thickness of about 1.5 mm; optionally the thickness is up to 2 mm, up to 2.5 mm or up to 5 mm; optionally, the thickness is between about 0.5 and about 3 mm, between about 1 and about 3 mm or between about 1 and about 2 mm; optionally, the thickness is at least 1 mm or at least 2 mm. In some cases the use of a different material will require the thickness to be adapted to provide a desired rigidity, in these cases the thickness may exceed or fall outside the specified exemplary values.

The invention claimed is:

1. A trim configured to attach substantially vertically between two domestic appliances, the trim comprising:

a longitudinal member extending predominantly in one dimension, a fin configured to protrude behind a longitudinal front surface of the longitudinal member, the fin being either continuous or in spaced-apart sections, and including fixing features configured to fixedly position the trim to at least one of the domestic appliances, the fixing features including:

a first said fixing feature at or near an upper end of the longitudinal member, wherein the first fixing feature is part of, on, or connected to, the fin, and a second said fixing feature at or near a lower end of the longitudinal member, wherein the second fixing feature is part of, on or connected to the fin, wherein the trim is unsupported between the first fixing feature and the second fixing feature by any additional said fixing features configured to fixedly position the trim in relation to at least one of the domestic appliances, and wherein the first fixing feature is configured to fix in a direction parallel to the longitudinal axis of the longitudinal member, and the second fixing feature is configured to fix in a direction perpendicular to the longitudinal axis of the longitudinal member.

2. The trim as claimed in claim 1, wherein at least one of the first and second fixing features is/are configured to extend into a gap between the two domestic appliances.

3. The trim as claimed in claim 1, wherein at least one of the first and second fixing features is/are configured to extend behind the longitudinal front surface of the longitudinal member.

4. The trim as claimed in claim 1, further comprising one or more additional fins configured to protrude behind the longitudinal front surface of the longitudinal member.

5. The trim as claimed in claim 1, wherein the fin extends substantially the length of the trim.

6. The trim as claimed in claim 1, wherein the fin extends between the first and second fixing features.

7. The trim as claimed in claim 1, wherein the longitudinal front surface and the fin are unitary.

8. The trim as claimed in claim 1, wherein at least one of the first and second fixing features comprises an opening configured to secure to a protrusion attached to at least one of the domestic appliances.

9. The trim as claimed in claim 1, wherein at least one of the first and second fixing features comprises an insert, the insert configured to attach to the trim and comprising a fixing surface.

10. The trim as claimed in claim 1, further comprising one or more contact features, the contact features configured to slidably contact at least one of the domestic appliances.

11. The trim as claimed in claim 10, wherein the contact feature is, or contact features are, magnetic.

12. The trim as claimed in claim 1, wherein the trim is formed as an extrusion.

13. An attachment system for attaching a trim between two domestic appliances, the attachment system comprising:

a trim as claimed in claim 1; and a first connecting feature configured to attach to at least one of the domestic appliances, wherein the first connecting feature is configured to mate with the first fixing feature of the trim.

14. The attachment system as claimed in claim 13, further comprising a second connecting feature configured to attach to at least one of the domestic appliances, wherein the second connecting feature is configured to mate with the second fixing feature of the trim.

15. The attachment system as claimed in claim 14, wherein at least one of the first and second fixing features comprises an opening configured to secure to a protrusion attached to at least one of the domestic appliances.

16. The attachment system as claimed in claim 14, wherein at least one of the first and second fixing features comprises an insert, the insert configured to attach to the trim and comprising a fixing surface.

17. A domestic appliance installation comprising:

two domestic appliances separated by a gap;

a first connecting feature attached to one of the domestic appliances;

a second connecting feature attached to one of the domestic appliances; and a trim for covering the gap, the trim having a longitudinal member extending predominantly in one dimension, a fin configured to protrude behind a longitudinal front surface of the longitudinal member, the fin being either continuous or in spaced-apart sections a first fixing feature at or near an upper end of the longitudinal member, and a second fixing feature at or near a lower end of the longitudinal member, the first and second fixing features being part of, on, or connected to, the fin, wherein the first connecting feature mates with the first fixing feature of the trim and the second connecting feature mates with the second fixing feature of the trim such that the first and second fixing features single-handedly fixedly position the trim to at least one of the domestic appliances, the trim being unsupported between the first fixing feature and the second fixing feature by any additional fixing features that fixedly position the trim in relation to at least one of the domestic appliances, and wherein the first fixing feature is configured to fix in a direction parallel to the longitudinal axis of the longitudinal member and the second fixing feature is configured to fix in a direction perpendicular to the longitudinal axis of the longitudinal member.

18. The domestic appliance installation as claimed in claim 17, wherein at least one of the first and second fixing features comprises an opening configured to secure to a protrusion attached to at least one of the domestic appliances.

19. The domestic appliance installation as claimed in claim 17, wherein at least one of the first and second fixing features comprises an insert, the insert configured to attach to the trim and comprising a fixing surface.

20. The domestic appliance installation as claimed in claim 17, further comprising one or more magnetic contact features, the magnetic contact features configured to slidably contact at least one of the domestic appliances.

* * * * *